US005217077A

United States Patent [19]

Hart

[11] Patent Number: 5,217,077

[45] Date of Patent: Jun. 8, 1993

[54] RESETTABLE PACKER

[75] Inventor: Daniel R. Hart, Sugar Land, Tex.

[73] Assignee: Baker Hughes Incorporated, Houston, Tex.

[21] Appl. No.: 718,553

[22] Filed: Jun. 20, 1991

[51] Int. Cl.[5] ..... E21B 33/127

[52] U.S. Cl. ..... 166/387; 166/129; 166/185; 166/187

[58] Field of Search ..... 166/387, 187, 128, 129, 166/182, 183, 185; 277/34, 34.3, 34.6

[56] References Cited

U.S. PATENT DOCUMENTS

| | | | |
|---|---|---|---|
| 4,082,298 | 4/1978 | Sanford | 166/187 X |
| 4,246,964 | 1/1981 | Brandell | 166/106 |
| 4,296,808 | 10/1981 | Baker et al. | 166/191 |
| 4,566,535 | 1/1986 | Sanford | 166/113 |
| 4,567,944 | 2/1986 | Zunkel et al. | 166/120 |
| 4,569,396 | 2/1986 | Brisco | 166/305.1 |
| 4,633,952 | 1/1987 | Ringgenberg | 166/336 |
| 4,648,448 | 3/1987 | Sanford et al. | 166/191 |
| 4,655,292 | 4/1987 | Halbardier | 166/187 X |
| 4,768,590 | 9/1988 | Sanford et al. | 166/187 |
| 4,796,707 | 1/1989 | Halbardier | 166/387 |
| 4,823,882 | 4/1989 | Stokley et al. | 166/387 |
| 4,856,583 | 8/1989 | Greenlee et al. | 166/127 |
| 4,893,678 | 1/1990 | Stokley et al. | 166/374 |
| 4,898,239 | 2/1990 | Rosenthal | 166/133 |
| 4,962,815 | 10/1990 | Schultz et al. | 166/387 |

OTHER PUBLICATIONS

TAM Int'L "Inflatable Perforation Wash Tool" 1980-81 General Catalog page.

Tam Int'L Jan. 1986 Tam J Inflatable Workover Testing Packers & Accessories Ordering Guide.

Tam Int'L Jul. 1986 Brochure "Tam J Heavy Duty Inflatable Packers for Well Testing, Workovers, and Production".

Lynes 1978-79 Catalog; Feb. 1989 Ocean Industry Magazine.

*Primary Examiner*—Terry Lee Melius

*Attorney, Agent, or Firm*—Rosenblatt & Associates

[57] ABSTRACT

A resettable downhole packer is provided. Circulation from the surface creates a backpressure behind the packing element that expands the packing element into contact with the wellbore or casing. The tool may be shifted to trap pressure behind the element to retain it in contact with the wellbore or casing while, at the same time permitting flow through the packing element for procedures such as injection or stimulation. The tool incorporates a release mechanism to facilitate retrieval of the tubing string if, for any reason, the tool becomes stuck. Provisions are incorporated into the design to maintain the packing element in a retracted position for the running in and removal to avoid damage to the packing element.

18 Claims, 2 Drawing Sheets

RESETTABLE PACKER

FIELD OF THE INVENTION

The field of this invention relates to downhole packers which are capable of multiple settings.

BACKGROUND OF THE INVENTION

While conducting certain operations downhole, it becomes necessary to relocate a packer from one elevation to another. In the past, resettable packers have employed an actuation system involving sequential griping and release of balls dropped from the surface at a particular point. The seating of the ball allowed pressure buildup behind the ball with subsequent movement of the internal components allowing selective inflation or deflation of the packing element to effectuate sealing off of the well bore. Typical of such packers are U.S. Pat. Nos. 4,823,882 and 4,893,678. Other packers or bridge plugs have been set and released by a combination of numerous interengaging components which are actuated by physical forces applied to them or by fluid pressure. Typical of such packers or bridge plugs are U.S. Pat. Nos. 4,898,239 and 4,796,707.

The disadvantages of the known designs range from their initial complexity and cost of construction to the time delays encountered by the dropping ball method of operation. There are delays associated with injecting and pumping a ball from the surface to a seat located downhole so that pressure can be built up behind the ball to initiate mechanical movement of the internal components. These delays can be as long as one to two hours to seat the ball. If this type of packer needs to be reset, the same delays must be repeated.

Another disadvantage of the designs involving dropping balls is that the seat must be constructed of a retractable nature so that the ball can be selectively released. The flow through the tool and repetitive operations could result in imperfect seating due to wear on the ball or failure of the seat elements to snap back into the position where they are properly located to effectuate a seat with the ball.

In low-fluid-level wells, prior designs that allow the element to deflate by displacement into the tubing have presented a problem since the hydrostatic head in the tubing could prevent element deflation. The apparatus of the present invention allows element deflation into the annulus.

The apparatus of the present invention is constructed simply and is operable by pressure developed at the surface. It also allows operations such as injection to go on below the set packer element while, at the same time, locking in the pressure behind the element to ensure it has a solid grip on the well bore or casing.

SUMMARY OF THE INVENTION

A resettable downhole packer is provided. Circulation from the surface creates a backpressure behind the packing element that expands the packing element into contact with the well bore or casing. The tool may be shifted to trap pressure behind the element to retain it in contact with the well bore or casing while, at the same time permitting flow through the packing element for procedures such as injection or stimulation. The tool incorporates a release mechanism to facilitate retrieval of the tubing string if, for any reason, the tool becomes stuck. Provisions are incorporated into the design to maintain the packing element in a retracted position for the running in to avoid damage to the packing element.

DETAILED DESCRIPTION OF THE DRAWINGS

DETAILED DESCRIPTION OF THE PREFERRED EMBODIMENT

Figure 6:
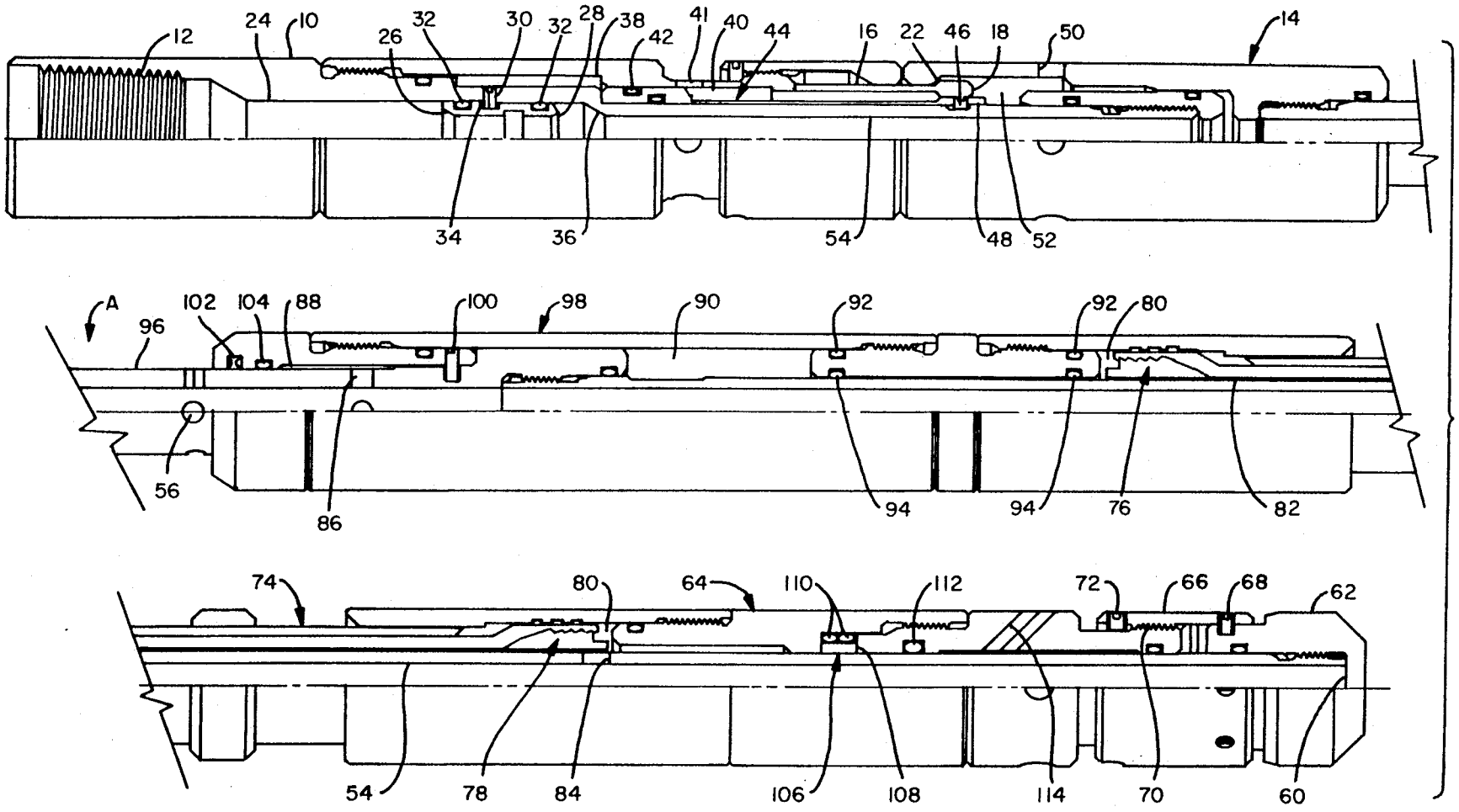
FIG. 6 is a sectional view of the tool in the running in position shown in FIG. 1 illustrating the interior components.

The apparatus A of the present invention is shown in detail in FIG. 6. The apparatus A consists of a top sub 10 which has threads 12 at the upper end for connection to a tubing string or coil tubing unit (not shown). The top sub 10 is connected to a mandrel 14 by virtue of collet fingers 16, each having a collet end 18 trapped by collet retainer 44 against shoulder 22.

In the event a quick release is required between top sub 10 and mandrel 14, a ball (not shown) is dropped through the tubing string or coil tubing unit (not shown) through bore 24 to seat against seat 26. Once the ball (not shown) seats against seat 26, pressure build-up from the surface forces ring 28 downwardly, shearing pin 30. Seals 32 disposed in ring 28 isolate pin 30 from bore 24 during normal operation of the apparatus A, as will be described below. Having moved ring 28 and sheared pin 30, pressure in bore 24 can enter openings in line with opening 34 as well as opening 34 in which pin 30 resided prior to its being sheared off. Ultimately, the downward movement of ring 28 is stopped as it hits tapered surface 36. The pressure in bore 24 passes through opening 34 and into cavity 38. Cavity 38 is separated from cavity 40. Seals 42 allow sealable movement of retainer 44 while retaining cavity 38 in isolation from cavity 40. Collet retainer 44 is initially held in place by shear pin 46. When the pressure is built up in cavity 38, a downward force is exerted on collet retainer 44 which ultimately shears pin 46 and allows collet retainer 44 to slide downwardly. Collet retainer 44 has an enlarged end section 48 which retain collet ends 18 in the position shown in FIG. 6 until such time as downward movement of collet retainer 44 results in shearing of pin 46 and movement of enlarged end section 48 away from collet ends 18. Thereafter, collet ends 18 are free to be biased inwardly to free mandrel 14 from top sub 10. Since enlarged end section 48 is no longer in place to prevent collet ends 18 from radial inward movement, the weight of the apparatus A acting through shoulder 22 biases the collet ends 18 inwardly until shoulder 22 is cleared, thereby disengaging top sub 10 from mandrel 14. A vent port 50 communicates with cavity 52. Those skilled in the art can see that downward movement of collet retainer 44 displaces fluid out of cavity 40 and 52 and out of the apparatus A through vent port 50. Movement of retainer 44 allows fluid communication between bore 24 and vent port 41, allowing the tubing string (not shown) to drain.

Figure 1:
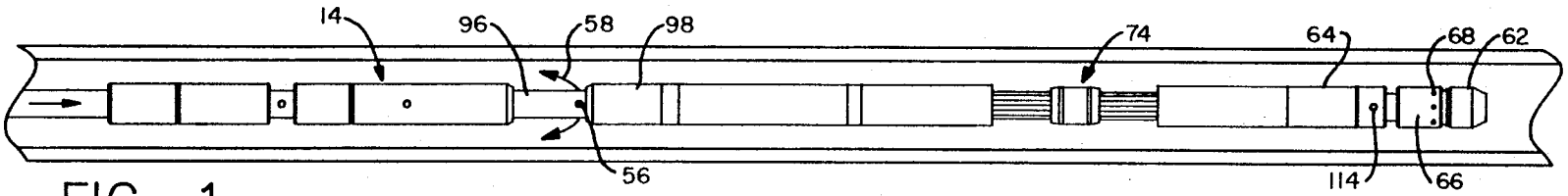
FIG. 1 is a schematic of the tool in the running in position.

Bore 24 continues until tapered surface 36, at which point it runs into bore 54. A plurality of openings 56 extend laterally from bore 54. When the apparatus A is in the position shown in FIG. 6, fluid pressure applied at the surface is able to escape the apparatus A by passing through bores 24, 54 and out through openings 56. This position is also illustrated graphically in FIG. 1 where arrows 58 represent the circulating flow from the surface exiting through openings 56. Bore 54 extends through the apparatus A until point 60 where cap 62 defines its termination. Cap 62 is connected to lower element retaining assembly 64 via ring 66. Ring 66 is temporarily held to cap 62 by shear pin 68. Ring 66 is connected to lower element retaining assembly 64 at thread 70. Set screw 72 keeps thread 70 from becoming undone.

Element 74 is retained by upper gripper 76 and lower gripper 78. The element 74 is inflated when backpressure develops in bore 54 as a result of circulation from the surface into bore 24 and out openings 56. The pressure then developed in bore 54 migrates into cavity 80. Cavity 80 extends on above and below element 74 as well as behind it as indicated by numeral 82.

Figure 2:
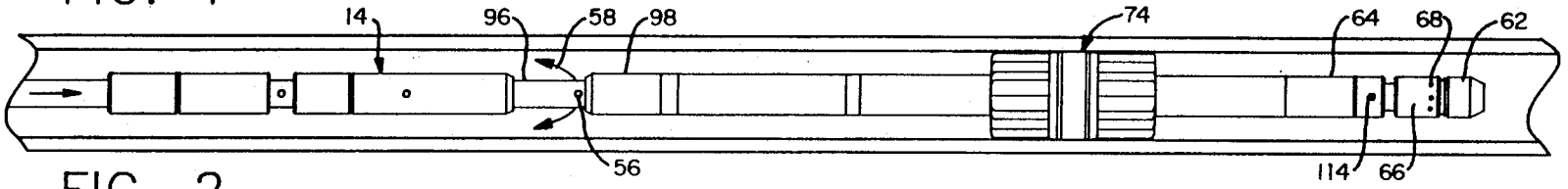
FIG. 2 is a schematic representation of the tool in the initial inflated position.

To initiate inflation of element 74 as shown in FIG. 2, the circulation from the surface is developed until sufficient pressure is generated in bore 54. The pressure in bore 54 enters cavity 80 through opening 84. It should be noted that opening 86 provides fluid communication from bore 54 into cavity 88. Cavity 88 is in fluid communication with cavity 90. Cavity 90 is isolated from the annulus by seals 92 and from cavity 80 by seals 94. Therefore, a build-up in pressure in bore 54 will only reach cavity 80 through opening 84. In the initial position shown in FIGS. 1 and 6, the pressure in bore 54 will also exist in opening 86 and cavities 88 and 90. However, the build-up of pressure in cavities 88 and 90 will not affect the element 74 due to the existence of seals 94.

A pressure build-up in cavities 80 and 82 will displace element 74 outwardly. That will pull up on lower element retaining assembly 64, which in turn will pull on ring 66 and shear pin 68. Once pin 68 is sheared, the connection between cap 62 and ring 66 is broken. The lower element retaining assembly 64 can then move in tandem with ring 66 due to the connection between those two elements at thread 70. At this time the assembly 64 moves with respect to tube 96, which is itself an extension of mandrel 14. Bore 54 is found inside of tube 96. By further increasing the circulation rate at the surface, element 74 is urged outwardly as shown in FIG. 2. At the same time, assembly 64 is pulled upwardly to allow element 74 to move outwardly. The entire assembly 64, including lower gripper 78, moves upwardly in a direction toward mandrel 14 to allow element 74 to move outwardly in contact with the casing or wellbore depending on the application.

Figure 3:
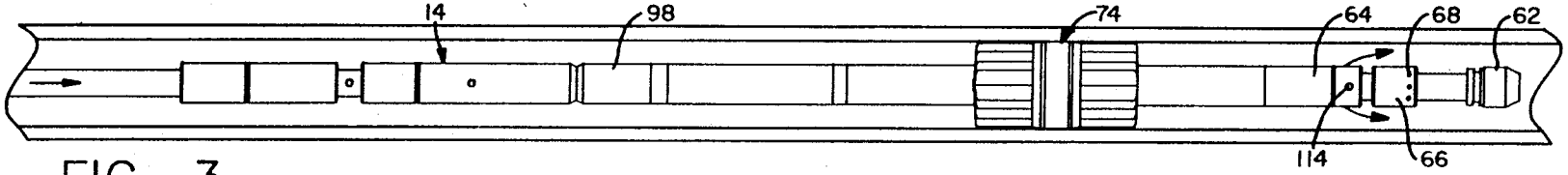
FIG. 3 is a schematic representation of the tool in the injection position.

Having fully expanded element 74 into contact with the casing or the borehole, it is desirable to place the tool into the position indicated in FIG. 3 to permit injection into the formation or other operations involving pumping on the downhole side of the expanded element 74. To accomplish this, the operator at the surface lets up on the tubing string or coil tubing unit (not shown), allowing mandrel 14 to come down with respect to upper element retaining assembly 98. Initial downward movement of tube 96 with respect to assembly 98 (which at that point is held stationary due to the inflation of element 74) results in shearing pin 100. After approximately one inch of movement, openings 56 pass beyond wiper 102 and O-ring 104. As this movement is going on, opening 84 is still aligned with cavity 80 so that the pre-existing pressure in bore 54 continues to be exerted into cavities 80 and 82, retaining element 74 in the expanded position as shown in FIG. 2. This situation persists until further movement of tube 96, connected to cap 62, with respect to upper assembly 98 and lower assembly 64, puts opening 84 beyond seal assembly 106. Seal 106 has a ring component 108 preferably made of PEEK (PolyEtherEtherKeytone), which is manufactured by Greene, Tweed & Company, and is backed by a pair of O-ring seals 110.

Further letting up at the surface results in further movement of mandrel 14 and tube 96, placing opening 84 between seal assembly 106 and seal 112. This, in effect, traps pressure in cavities 80 and 82 to retain the element 74 in an expanded position shown in FIGS. 2 and 3. Further downward movement of tube 96, with respect to upper assembly 98 and lower assembly 64, puts opening 84 beyond seal 112. Since opening 84 has moved beyond seal assembly 106 and locked in the pressure causing element 74 to remain inflated, movement of opening 84 beyond seal 112 puts bore 54 in communication with ports 114. Thereafter, pumping from the surface can proceed through bores 24 and 54, through 84, out bores 114 as illustrated in FIG. 3. This is the injection position. By this time, ports 56 are moved beyond seal 104, closing them off. Ports 56 clear seal 104 prior to port 84 clearing seal 106.

In the preferred embodiment, a double seal arrangement using seals 106 and 112 spaced apart is used. This is done primarily to avoid the potential of extruding the seal if a singular seal was used. This arrangement also promotes retention of pressure on element 74. Subjecting the seal to sudden dramatic pressure differentials could result in dislocation from its mounted position and potential damage. However, it is within the purview of the invention to design and supply a single seal arrangement to replace seals 106 and 112.

Figure 4:
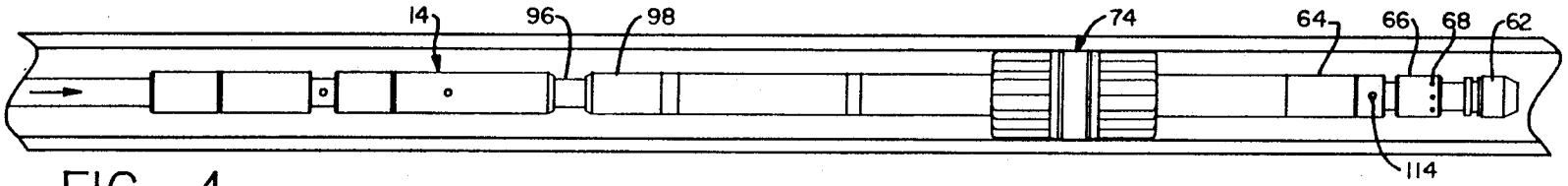
FIG. 4 is a schematic representation of the tool in the final inflate position.

As shown in FIG. 4, the injection port 114 can be closed back off by pulling up at the surface on mandrel 14, which pulls up on tube 96, which in turn brings opening 84 back up past seal 112. In this position, the tool is as illustrated in FIG. 4.

Figure 5:
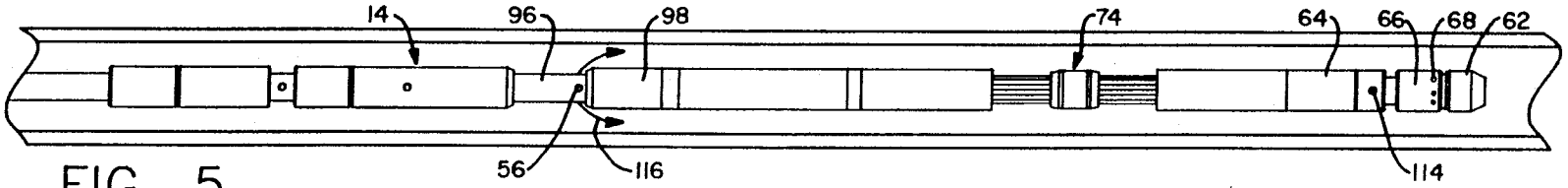
FIG. 5 is a schematic representation of the tool in the deflated position.

To deflate the element 74, the operator at the surface picks up on the tubing string, pulling mandrel 14 upward until openings 56 clear seal 104. At that point, without circulation from the surface the pressure previously trapped in cavities 80 and 82 is allowed to vent through opening 84 into bore 54, out openings 56. That is the position illustrated in FIG. 5 with arrows 116 showing the fluid escaping from cavities 80 and 82. The tool can then be pulled up with the tubing string to the surface.

It should be noted that the arrangement of lower assembly 64 connected to ring 66 and held to cap 62 by shear pin 68 serves to retain element 74 in the retracted position, as shown in FIG. 6, while the tool is being run into the well. This minimizes damage to element 74 on the trip into the well until it is brought to a desired depth.

If during operations the apparatus A loses its grip on the wellbore or casing, the apparatus A can easily be reset by pulling up at the surface sufficient to expose openings 56 without circulation. The tool can then be moved up or down as desired. When the proper elevation is reached, circulation from the surface is restarted with openings 56 exposed as shown in FIG. 6. The re-establishing of circulation from the surface increases pressure in bore 54 and reinflates element 74 as previously described. Thereafter, the operator at the surface lets up on the tubing string or coiled tubing unit. The weight indicator on the string will immediately reveal whether element 74 has obtained a sufficiently tight grip on the casing or wellbore. The resetting of the apparatus A is a simple operation that just takes minutes as opposed to prior designs which require dropping balls and circulating them down to a seat. These types of packers can take as much as several hours to reset, creating additional expense for the operator.

Apart from facilitating the setting and resetting of the element, the apparatus A provides the additional feature of being able to selectively open an injection port which bypasses the packer for further downhole operations.

The foregoing disclosure and description of the invention are illustrative and explanatory thereof, and various changes in the size, shape and materials, as well as in the details of the illustrated construction, may be made without departing from the spirit of the invention.

What is claimed is:

1. A packer for use in a borehole comprising:

a housing;

a packing element on said housing selectively engageable from a retracted position for running into a borehole to an expanded position for sealing off a borehole; and pressure regulation means in said housing to permit buildup of back pressure or to vent pressure applied within said housing for actuation of said packing element between said expanded and retracted positions by virtue of selective use of circulating fluid pressure in a flow path comprising a flow restriction.

2. The apparatus of claim 1 further comprising:

means for retaining said packing element in said retracted position while it is inserted into a borehole to reduce possibility of damage to said element.

3. A packer for use in a borehole comprising:

a housing;

a packing element on said housing selectively engageable from a retracted position for running into a borehole to an expanded position for sealing off a borehole;

pressure regulation means in said housing to permit buildup or vent pressure applied within said housing for actuation of said packing element between said expanded and retracted positions;

means for retaining said packing element in said retracted position while it is inserted into a borehole to reduce possibility of damage to said element;

said housing further comprises:

a bore;

an element inflation cavity selectively providing for communication between said bore and said element;

a vent port from said housing selectively allowing fluid communication therethrough from said bore;

said pressure regulation means selectively allowing pressure in said bore to be communicated to said cavity and said vent port; and said vent port sized to create a backpressure upon fluid flow into said bore which results in moving said element to said expanded position.

4. The apparatus of claim 3 wherein said pressure regulation means further comprises:

means for trapping pressure in said cavity to retain said element in said expanded position by blocking said vent port.

5. The apparatus of claim 4 further comprising:

an exit port from said housing; and said pressure regulation means selectively placing said bore in flow communication with said exit port while retaining trapped pressure in said cavity to allow said element to seal off the wellbore while providing fluid communication beyond said element through said bore and exit port.

6. The apparatus of claim 5 further comprising:

said bore and said vent port disposed on a mandrel selectively movable with respect to said housing;

said exit port disposed on said housing; and said mandrel releasably held to said housing to hold said vent port in a position to allow flow therethrough when interengaged and to selectively close flow through said vent port when not interengaged.

7. The apparatus of claim 6 further comprising:

sealing means to seal between said housing and said mandrel;

said mandrel movable in a plurality of positions with respect to said housing as follows:

a first position where said vent port is outside said housing, said bore is in flow communication with said cavity and said sealing means seals off said exit port from said bore;

a second position where said vent port is sealingly disposed within said housing said cavity is isolated from said bore and said bore is isolated from said exit port; and a third position identical to said second position except that said bore is aligned with said exit port.

8. The apparatus of claim 7 wherein:

said sealing means is a pair of seals offset from each other; and said bore has a lateral port selectively aligned with said cavity in said first position of said mandrel, disposed between said seals in said second position of said mandrel, and disposed adjacent said exit port and on the opposite side of said seals from said cavity, when said mandrel is in said third position.

9. The apparatus of claim 8 wherein:

said mandrel is releasably engaged to said housing in at least one point;

said element is a portion of said housing and is retained in said retracted position due to selective engagement between said mandrel and said housing; and defeat of said at least one releasable engagement between said housing and said mandrel occurring on inflation of said element, drawing at least a portion of said housing into movement with respect to said mandrel to allow said element to move to its said expanded position.

10. The apparatus of claim 9 wherein:

said housing retained on two points, one on either side of said element;

said first retention point, adjacent a downwardmost portion of said mandrel, is a shear pin that shears on inflation of said mandrel; and said second retention point, adjacent the uppermost portion of said mandrel, is a second shear pin that is sheared as said mandrel is moved from said first position toward said second position.

11. The apparatus of claim 10 further comprising:

a top sub connected to said mandrel;

quick release means between said top sub and said mandrel to selectively release said mandrel from said top sub further comprising:

a collet shoulder in said mandrel;

said top sub comprising a plurality of collets;

a retainer holding said collets against said shoulder; and displacement means for shifting said retainer to allow said collets to move away from said shoulder releasing said mandrel.

12. The apparatus of claim 11 further comprising:

a ring having a seat thereon releasably held to said top sub and circumscribing a bore thereon;

a sealing member insertable in said top sub to engage said seat;

said ring held to said top sub by a shear pin;

said sealing member when against said seat allowing pressure buildup to shift said ring, shearing said pin; and said shearing of said pin allowing fluid communication from said bore in said top sub to said retainer whereupon pressure shifts said retainer thereby allowing movement of said collets away from said shoulder, releasing said mandrel.

13. A retrievable packer comprising:

a housing;

an element connected to said housing actuable between a retracted and expanded position;

backpressure means comprising a flow restriction in said housing for creating a backpressure resulting from fluid circulation through said flow restriction, said backpressure acting against said element for inflation thereof; and injection means for selectively retaining said element in said expanded position while allowing fluid communication beyond said inflated element through said housing.

14. A method of packing off a wellbore while allowing flow beyond the packer comprising:

lowering a retrievable packer on a string into a wellbore;

pumping fluid into the string;

creating a backpressure within the packer housing by allowing the circulated fluid to escape the packer housing through a flow restriction; and inflating an element with said backpressure.

15. The method of claim 14 further comprising:

retaining the element in a retracted position as the packer is set in the well;

overcoming said retaining by inflation of the packer element; and trapping the fluid behind the element to keep the element inflated.

16. A method of packing off a wellbore while allowing flow beyond the packer comprising:

lowering a retrievable packer on a string into a wellbore;

pumping fluid into the string;

creating a backpressure within the packer housing by allowing the circulated fluid to escape the packer housing;

inflating an element with said backpressure;

retaining the element in a retracted position as the packer is set in the well;

overcoming said retaining by inflation of the packer element;

trapping the fluid behind the element to keep the element inflated;

aligning an exit port located below the inflated element to a bore within the packer body; and pumping fluids through the string, through the bore in the packer body and out the exit port.

17. A method of packing off a wellbore while allowing flow beyond the packer comprising:

lowering a retrievable packer on a string into a wellbore;

pumping fluid into the string;

creating a backpressure within the packer housing by allowing the circulated fluid to escape the packer housing;

inflating an element with said backpressure;

retaining the element in a retracted position as the packer is set in the well;

overcoming said retaining by inflation of the packer element;

trapping the fluid behind the element to keep the element inflated;

moving a portion of the housing with respect to another;

exposing a circulation port;

allowing trapped pressure acting on the element to escape from said vent port; and resetting or removing the packer.

18. The method of claim 17 further comprising initially exposing the vent port and a chamber adjacent the element to a bore in the housing;

inflating the element by circulating through the vent port with said chamber in the flow path;

closing off the vent port by retraction into the housing;

closing off said chamber by further movement of one portion of said housing with respect to another portion;

opening up the exit port while holding said chamber isolated with trapped fluid pressure; and pumping through the packer housing with the element inflated.

* * * * *